US006249083B1

(12) United States Patent
Kim

(10) Patent No.: US 6,249,083 B1
(45) Date of Patent: Jun. 19, 2001

(54) ELECTRIC FIELD EMISSION DISPLAY (FED) AND METHOD OF MANUFACTURING SPACER THEREOF

(75) Inventor: Jong-min Kim, Yongin (KR)

(73) Assignee: Samsung Display Devices Co., Ltd. (KR)

( * ) Notice: Subject to any disclaimer, the term of this patent is extended or adjusted under 35 U.S.C. 154(b) by 0 days.

(21) Appl. No.: 09/197,512

(22) Filed: Nov. 23, 1998

(30) Foreign Application Priority Data

Jan. 12, 1998 (KR) ..... 98-546
Jan. 12, 1998 (KR) ..... 98-547

(51) Int. Cl.[7] ..... H01J 1/62; H01J 63/04; H01J 1/46; H01J 21/10; H01J 1/02

(52) U.S. Cl. ..... 313/495; 313/496; 313/497; 313/309; 313/306; 313/307; 313/351; 313/292; 313/238

(58) Field of Search ..... 313/306–307, 313/309, 308, 310, 311, 336, 351, 495, 496, 497, 549, 553, 554, 555, 558, 559, 560, 561, 562, 238, 292, 243, 256, 258, 261, 268, 281, 286, 288, 284–85; 220/445–448

(56) References Cited

U.S. PATENT DOCUMENTS 5,541,473 * 7/1996 Duboc, Jr. et al. ..... 313/495 X
5,545,946 * 8/1996 Wiemann et al. ..... 313/496 X
5,656,887 * 8/1997 Voshell et al. ..... 313/495 X
5,770,918 * 6/1998 Kawate et al. ..... 313/495
5,777,432 * 7/1998 Xie ..... 313/495
5,789,859 * 8/1998 Watkins et al. ..... 313/559 X

* cited by examiner

*Primary Examiner*—Nimeshkumar D. Patel
*Assistant Examiner*—Mack Haynes
(74) *Attorney, Agent, or Firm*—Burns, Doane, Swecker & Mathis LLP

(57) ABSTRACT

An electric field emission display (FED) and a method for manufacturing a spacer thereof are provided. The FED includes a spacer having a structure in which a multi-focusing electrode layer, an electron beam amplifying layer and a getter layer are stacked between an anode and a cathode, or a spacer having a structure in which a first electrode layer, a first insulating layer, a second electrode layer, a second insulating layer, a third electrode layer, a third insulating layer and a fourth electrode layer are sequentially stacked. Thus, electron beams can be easily focused by the multi-focusing electrode of the spacer, and high luminance can be realized at low current due to electron beam amplification of the electron amplifying apparatus. Also, the diamond tip is used as an electron emission means, to thereby obtain a low driving voltage, stability at a high temperature, and high thermal conductivity. Also, a getter formed of a thin film is used, to thereby minimize a getter adhesion space, and an insulating layer formed of ceramic is used, to thereby suppress leakage current of the electrodes. According to the method for manufacturing the FED and a spacer thereof, time for manufacturing the spacer is reduced, and support stiffness is increased by the insulating layers formed of ceramic interposed between the electrode layers, to thereby increase the aspect ratio of the spacer to a desired level. Also, a multitude of electrode layers to which the negative voltage is applied, is provided in the spacer, to thereby suppress absorption of electrons to the surface of the spacer, and the number of electrons colliding against the fluorescent material is increased, to thereby increase the luminance of the device.

10 Claims, 7 Drawing Sheets

ELECTRIC FIELD EMISSION DISPLAY (FED) AND METHOD OF MANUFACTURING SPACER THEREOF

BACKGROUND OF THE INVENTION

1. Field of the Invention

The present invention relates to an electric field emission display (FED), and more particularly, to an FED having a spacer for maintaining a predetermined distance between an anode and a cathode, obtained by stacking a multitude of insulating materials and electrode material, and to a method of manufacturing a spacer of the FED.

2. Description of the Related Art

An electric field emission display (FED) which is a flat panel display, uses a phenomenon in which electrons emitted from an electron gun of each of pixels collide against a fluorescent material due to a strong electrical field formed between an anode and a cathode to emit light beams from the fluorescent material. The FED has a large merit, compared to a cathode ray tube (CRT). That is, the FED has a wide viewing angle, excellent resolution, a low driving voltage, and stability with respect to temperature. Thus, the FED which is currently used for military applications or a view finder for a video camera is expected to be used in car navigation systems, notebook computers, and high definition televisions (HDTV).

FIG. 1 is a sectional view of a conventional field emission display (FED).

Referring to FIG. 1, in the conventional FED 10, indium tin oxide (ITO) glass plates 11 and 12 are provided in upper and lower portions, and a frit glass (not shown) is provided at the sidewall. Also, the inside of the upper ITO glass plate 11 has an anode (not shown) obtained by patterning the ITO glass to have a predetermined form, and red (R), green (G), and blue (B) fluorescent materials 14 are coated on the anode. Also, the upper surface of the lower ITO glass plate 12 includes a cathode line 15 formed by patterning the ITO glass to have a predetermined form, and a Mo tip 16 for emitting electrons and a gate 17 for applying a constant voltage to emit electrons are alternately arranged on the cathode line 15.

The conventional FED must operate in a high vacuum state to increase mean free path of electrons emitted from the Mo tip 16. However, an increase in the area of the screen causes a warping of the screen in high vacuum conditions, so that spacers must be provided. Thus, an individual spacer is bonded between the upper ITO glass plate 11 and the lower ITO glass plate 12, thereby increasing the manufacturing cost of the spacers, and the bonding process is difficult. Also, the conventional FED uses the Mo tip 16, so that the electron emission efficiency is deteriorated due to oxidation of the Mo tip 16 during frit glass firing at a high temperature. Also, a $SiO_2$ layer having a thickness of 1 $\mu$m is used between the gate 17 and the cathode line 15, so that leakage current is generated when a high voltage is applied. Also, the conventional FED employs a vaporable getter tube to obtain high vacuum, so that the volume of the display device is increased. More electrodes emitted from the Mo tip 16 become spread, to thereby generate cross-talk, and lower the luminance of the fluorescent material 14.

Meanwhile, FIG. 2 is a sectional view showing the structure of another conventional FED.

Referring to FIG. 2, the above FED has a structure similar to that of the FED of FIG. 1. However, spacers are provided between the field emission arrays. That is, the spacer 23 between an anode plate 21 of the FED 20 and a cathode plate 22 is provided, thereby the anode plate 21 and the cathode plate 22 are supported spaced a predetermined distance. Also, an anode 21*a* and a cathode 22*a* are provided on the anode plate 21 and the cathode plate 22, respectively, and a multitude of microtips 24 spaced a predetermined distance apart from each other are formed on the cathode plate 22. The microtips 24 are provided in the passing hole 26 surrounded by the insulating layer 25 formed on the cathode plate 22. Also, the gates 27 are stacked on the insulating layer 25. R, G, and B fluorescent materials 28 are coated on the anode 21*a*. Here, the spacer 23 functions as a support maintaining the interval between the anode plate 21 and the cathode plate 22. The spacer 23 is formed by screen-printing a glass paste several times using a mask 29, as shown in FIG. 3.

However, in the method of manufacturing a spacer using the above conventional screen printing method, processes of screen printing and curing are repeated approximately seven times, such that the height of the spacer 23 which becomes an interval between the anode plate 21 and the cathode plate 22 is 200 $\mu$m. Thus, much time is required, the glass paste flows down during curing, or it is difficult to increase the aspect ratio of the height vs the occupying width of the spacer 23 in the surface of the supported object, 23 due to misalignment during the repeated process.

Also, the spacer 23 formed of glass having insulation does not have electrical repelling force with respect to electrons. Thus, the electrons emitted from the microtips 24 are partially absorbed into the spacer 23 while proceeding toward the anode 21*a,* and thus the number of electrons colliding against the fluorescent material 28 of the surface of the anode 21*a* is reduced, to thereby deteriorate the luminance.

SUMMARY OF THE INVENTION

To solve the above problems, it is an objective of the present invention to provide a field emission display (FED) in which a spacer is formed by stacking a plurality of insulating materials and electrode materials, to thereby enhance the amplification and focusing function of electron beams.

It is another objective of the present invention to provide an FED capable of suppressing adsorption of electrons to the surface of the spacer to enhance the luminance.

It is still another objective of the present invention to provide a method for manufacturing a spacer of an FED capable of increasing an aspect ratio of the spacer, and reducing the time for the process of manufacturing the FED.

Accordingly, to achieve the above first objective, there is provided an FED including a glass substrate having a fluorescent material on the inside thereof, and functioning as an anode, and another glass substrate having tips for emitting electrons on the inside thereof and functioning as a cathode, wherein a spacer is formed between two substrates to maintain a predetermined interval, and the spacer is composed of a multi-focusing electrode layer, an electron beam amplifying layer and a getter layer, and the tips are formed of diamond.

To achieve the second objective, there is provided an FED having an anode plate and a cathode plate facing each other and spaced a predetermined distance from each other, an anode and a cathode formed on the anode plate and the cathode plate in a predetermined pattern, microtips arranged on the cathode plate having a predetermined spacing, an insulating layer formed on the cathode to surround the microtips, a gate having an opening to open the upper portion of the microtips, stacked on the insulating layer, and at least one spacer between the anode plate and the cathode plate to maintain the interval between the anode plate and the cathode plate, wherein the spacer includes a passing hole for supplying a path of electrons emitted from the microtips, and a complicatedly stacked structure in which a plurality of electrode layers and insulating layers are alternately stacked, and upper and lower supports formed on the upper and the lower portions of the complicated stacked structure, connecting the structure to the anode plate and the cathode plate, respectively.

Here, the complicated stacked structure is formed by sequentially stacking a first electrode layer, a first insulating layer, a second electrode layer, a second insulating layer, a third electrode layer, a third insulating layer, and a fourth electrode layer, and the first, the second, and the third insulating layers are formed of ceramic.

To achieve the third objective, there is provided a method for manufacturing a spacer of an electric field emission display (FED) comprising the steps of:

(a) forming a complicated stacked structure in which an insulating layer is interposed between a plurality of metal plates used for an electrode layer;

(b) forming a multitude of passing holes for an electron path on the complicated stacked structure obtained by the step (a); and (c) forming a support for supporting the complicated stacked structure in the upper and the lower portions of the complicated stacked structure, respectively.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
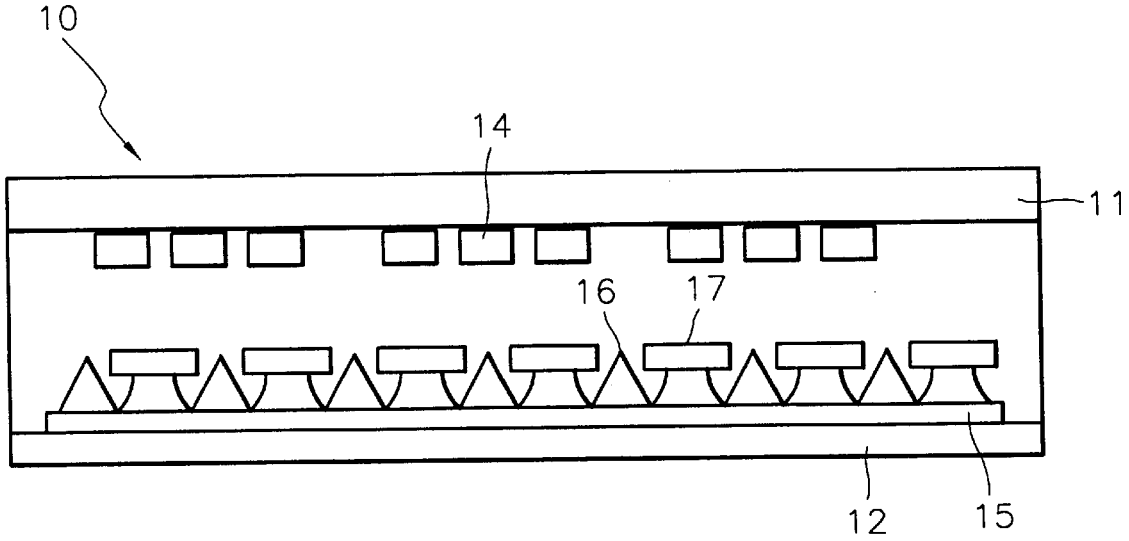
FIG. 1(PRIOR ART)
FIG. 1 is a sectional view showing the structure of a conventional field emission display (FED)
Figure 2:
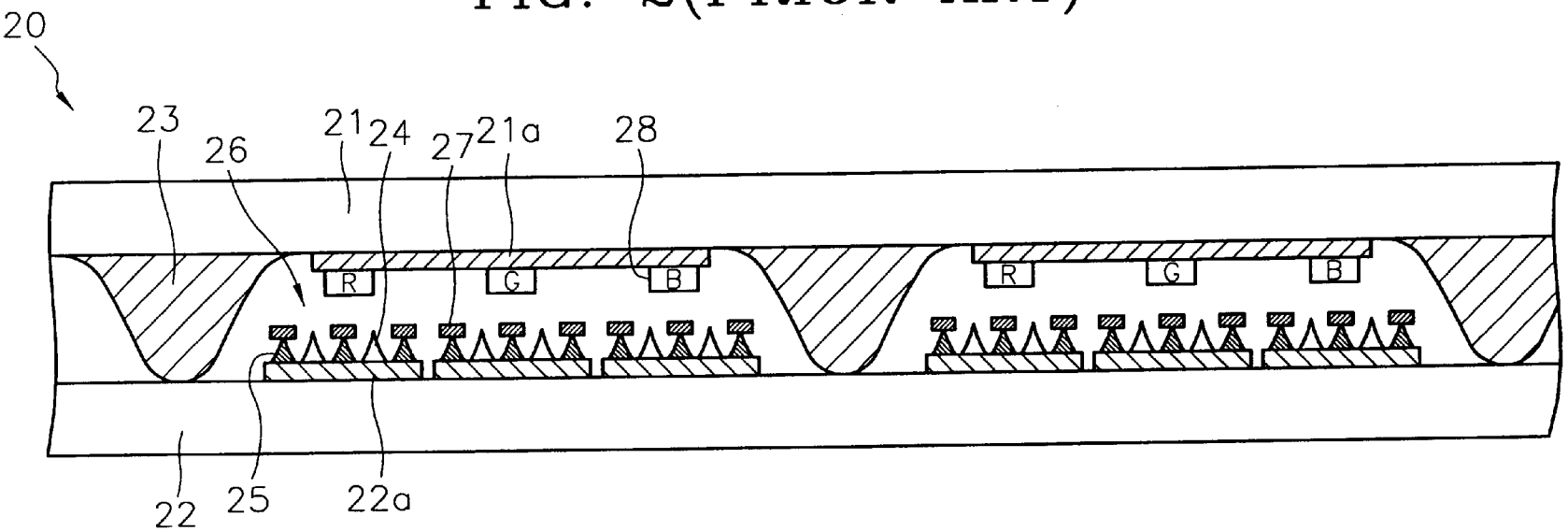
FIG. 2(PRIOR ART)
FIG. 2 is a sectional view showing the structure of another conventional FED.
Figure 3:
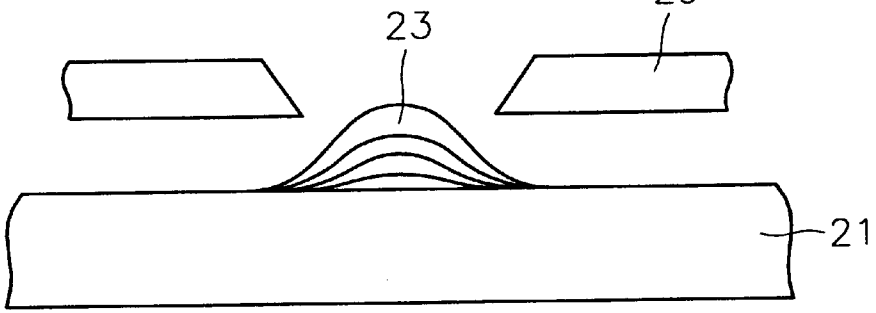
FIG. 3(PRIOR ART)
FIG. 3 is a schematic view for illustrating a method for manufacturing a spacer of the FED of FIG. 2.
Figure 4:
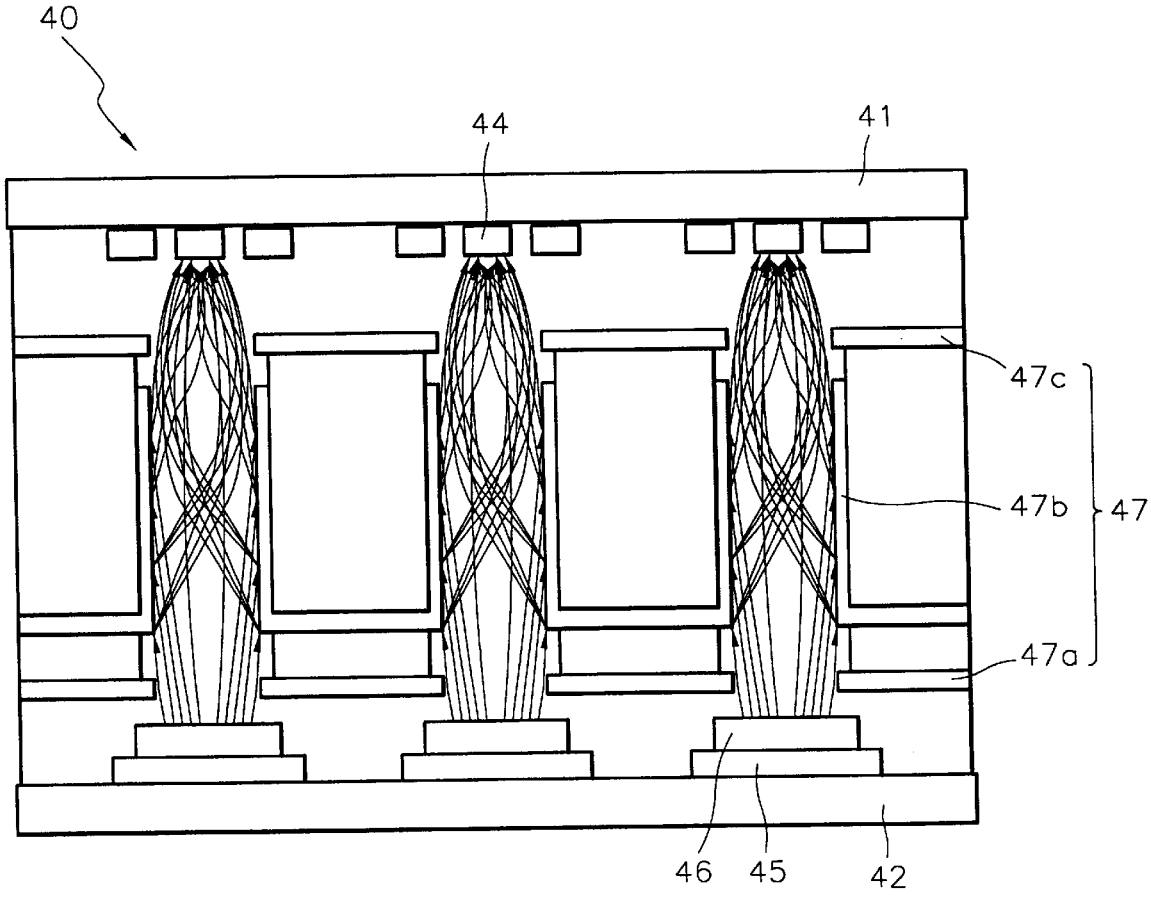
FIG. 4 is a sectional view showing the structure of an FED according to a first embodiment of the present invention.

Referring to FIG. 4, a field emission display (FED) 40 according to a first embodiment of the present invention includes ITO glass plates 41 and 42, spaced apart a predetermined interval in the upper and the lower portions, and a frit glass (not shown) on the side. The inside of the upper ITO glass plate 41 includes an anode (not shown) formed by patterning the ITO glass to have a predetermined form, where red (R), green (G), and blue (B) fluorescent materials 44 are coated on the anode. At this time, the fluorescent material 44 is screened by electrolytic plating.

The upper surface of the lower ITO glass plate 42 includes a cathode line 45 obtained by patterning the ITO glass to have a predetermined form, where a diamond tip 46 for emitting electrons is installed on the cathode line 45. Also, a spacer 47 for maintaining an interval between the upper and the lower glass plates 41 and 42 is provided between the upper and the lower ITO glass plates 41 and 42. Here, the spacer 47 includes three pieces of insulating green sheets which are bonded to each other. That is, tungsten is printed on the first green sheet to form a multi-focusing electrode 47*a*. Also, a via hole is formed on the second green sheet, and then the tungsten is printed to form an electrode, and an electron amplifying material (CDS) is deposited in the via hole to form an electron amplifying apparatus 47*b*. The third green sheet in a bare state adheres to the first and the second green sheets, and then the resultant structure is sintered to manufacture a multi-layered spacer. Then, titanium (Ti) which is a getter material is deposited on the surface of the third green sheet using the electron beam depositor, to form a getter 47*c*.

In the above FED, electrons emitted from the diamond tip 46 accelerate toward a fluorescent material 44 to which a stronger positive voltage is applied and collide against the fluorescent material 44, to thereby emit light beams from the fluorescent material 44. In the above process, electrons emitted from the diamond tip 46 are focused and amplified by an electron amplifying material CDs deposited on the inner wall of the electron amplifying apparatus 47*b* of the spacer 47 to be accelerated as shown in FIG. 4. Thus, the speed of the electrons colliding against the fluorescent material 44 is increased, and the number of colliding electrons is increased. As a result, light emission from the fluorescent material 44 is more active, to thereby increase the luminance.

Figure 5:
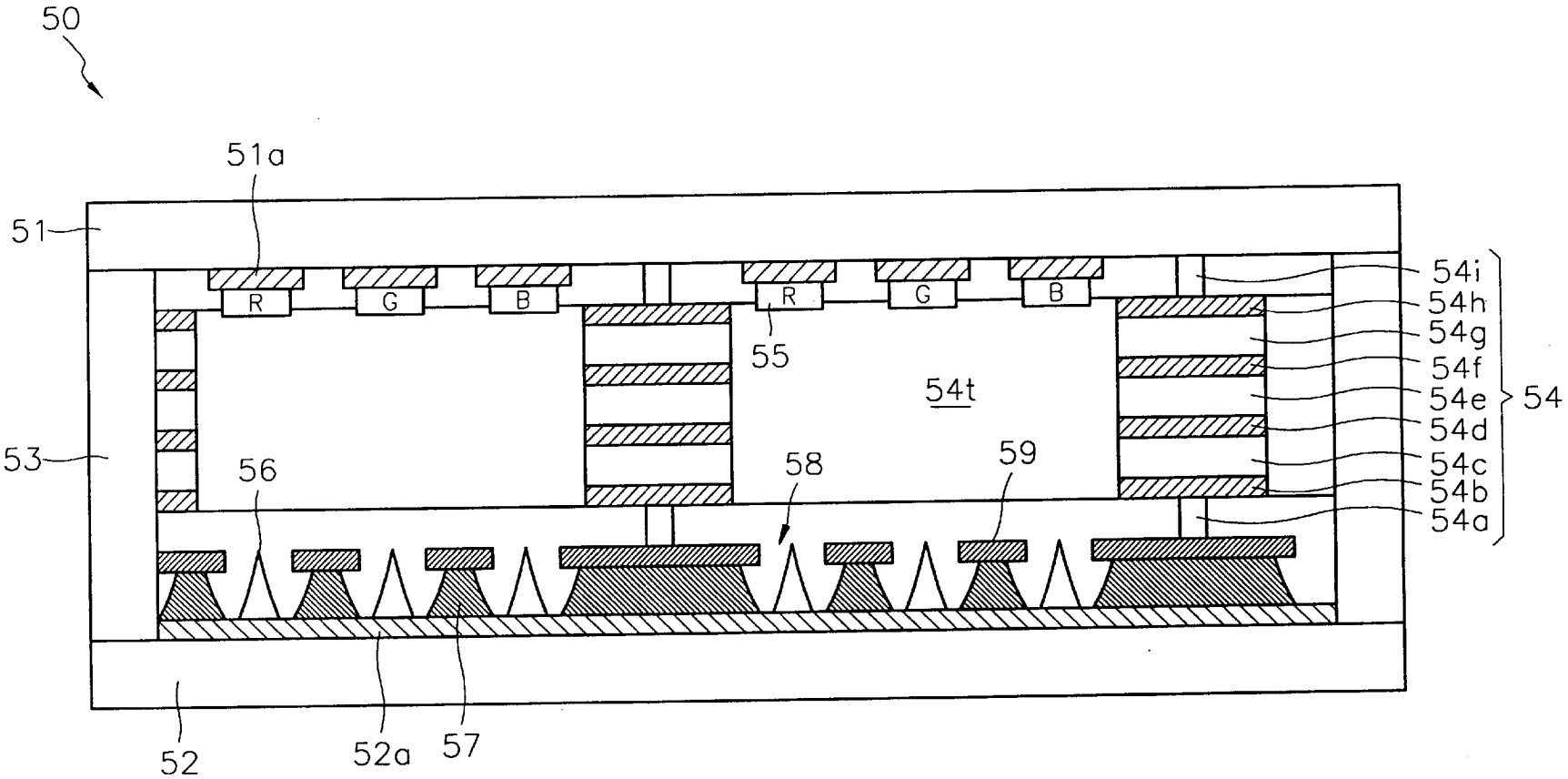
FIG. 5 is a sectional view showing the structure of an FED according to a second embodiment of the present invention.

Meanwhile, referring to FIG. 5, the FED 50 of the second embodiment includes an anode plate 51, a cathode plate 52, and a sealant member 53 which form an air-tight space, and a spacer 54 for spacing the anode plate 51 a predetermined distance from the cathode plate 52.

An anode 51*a* and a cathode 52*a* are provided on the anode plate 51 and the cathode plate 52, respectively, where R, G, B fluorescent materials 55 are coated on the anode 51*a*. A multitude of microtips 56 are formed on the cathode 52*a*, spaced a predetermined distance apart from each other. The microtips 56 are installed in a passing hole 58 surrounded with an insulating layer 57 formed on the cathode 52*a*. Also, gates 59 are stacked on the insulating layer 57.

The spacer 54 has a structure in which a first electrode layer 54*b*, a first insulating layer 54*c*, a second electrode layer 54*d*, a second insulating layer 54*e*, a third electrode layer 54*f*, a third insulating layer 54*g*, and a fourth electrode layer 54*h* are sequentially stacked between an upper support 54*i* and a lower support 54*a*. Here, each of the insulating layers 54*c*, 54*e*, and 54*g* are formed of ceramic. Reference numeral 54*t* denotes a passing hole through which electrons emitted from the microtips 56 moves to the anode 51*a*.

A positive (+) voltage of a predetermined level for accelerating electrons emitted from the microtips 56 is applied to a first electrode layer 54*b* of the above spacer 54, and a negative (−) voltage of a predetermined level is applied to second, third, and fourth electrode layers 54*d*, 54*f*, and 54*h* to focus electron beams to a fluorescent material 55 using an electron lens. Thus, a positive (+) bias voltage of a predetermined level is applied to a gate 59 and the electrons emitted from the microtips 56 by an electric field emission are induced toward the first electrode layer 54*b* due to the positive voltage applied to the first electrode layer 54*b*. Then, the electrons are moved to the anode 51*a* to which a positive voltage higher than that of the first electrode layer 54*b* is applied. At this time, the electrons move through the passing hole 54*t* of the spacer 54.

During the series of the above processes, the electrons are repelled by the negative (–) voltage applied to the second, third, and fourth electron layers 54*d*, 54*f*, and 54*h*, and thus the electron beams are focused to the center of the passing hole 54*t*, to thereby focus a proceeding orbit of the electrons to the fluorescent material 55. The electrons toward the inner wall of the passing hole 54*t* of the spacer 54 are repelled by the second, third, and fourth electrode layers 54*d*, 54*f*, and 54*h* to which the negative (–) voltage is applied, to restrain absorption to the surface of the spacer 54. As a result, the number of electrons colliding against the fluorescent material 55 is increased, to thereby enhance the luminance of the device.

The method for manufacturing the spacer 54 of the FED of the second embodiment will be described with reference to FIGS. 6 through 10.

Figure 6:
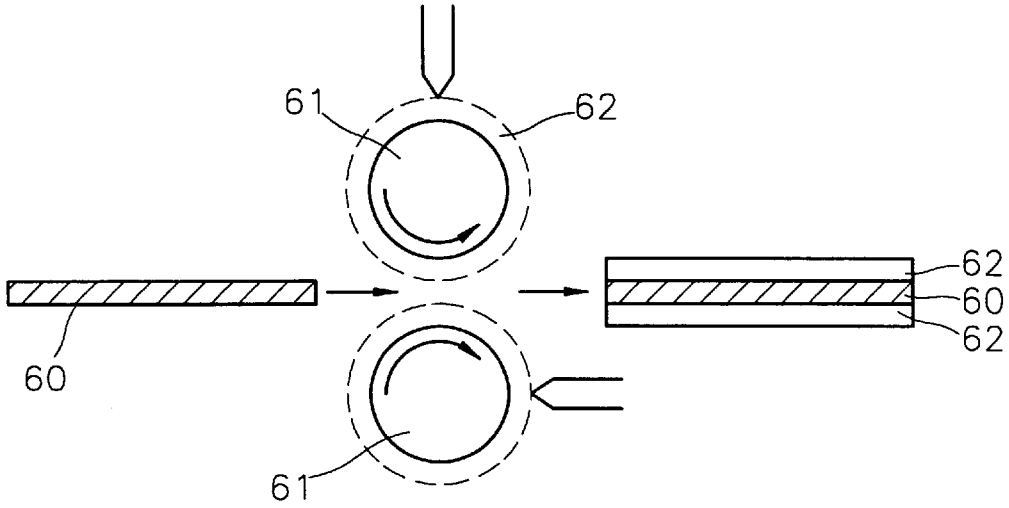
FIGS. 6 through 10 are diagrams for illustrating the process of manufacturing a spacer of the FED of FIG. 5.
Figure 7:
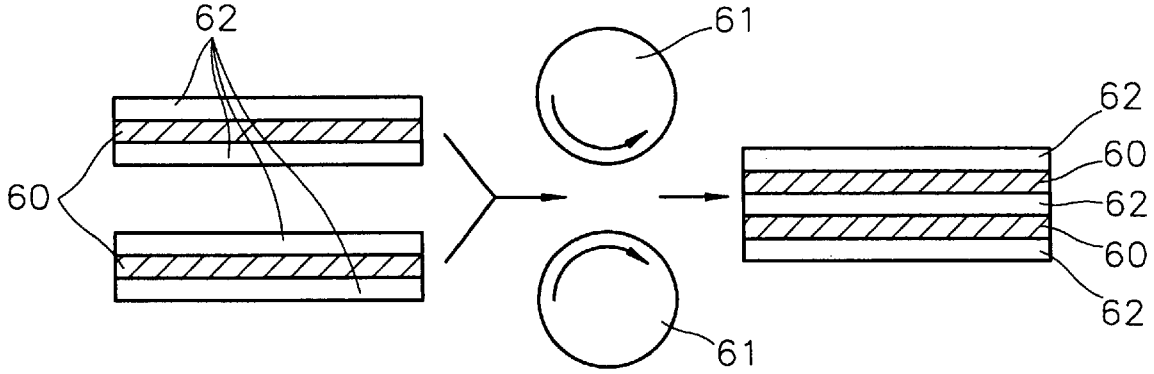
Figure 8:
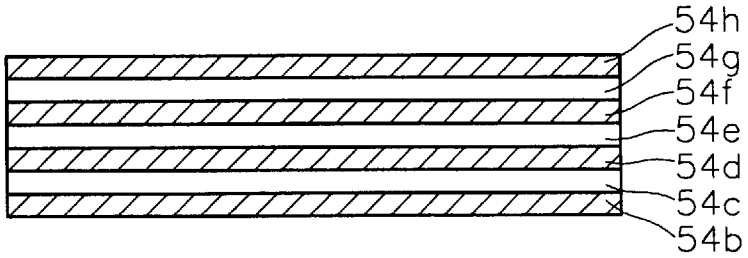

Referring to FIG. 6, a metal plate 60 capable of being used for an electrode layer passes between rollers 61 coated with a ceramic paste 62 which is an insulating material and has high support stiffness in the solid state, to thereby form an insulating layer formed of the ceramic paste 62 on the upper and the lower surfaces of the metal plate 60. The above process is performed with respect to another metal plate 60, and thus the two resultant structures are placed onto each other and pass between the rollers 61, to thereby be bonded by compression. Then, different metal plates are bonded to the upper and the lower surfaces of the upper and the lower insulating layers 62 of the resultant structure, respectively, to thereby obtain a structure having a basic frame of the spacer as shown in FIG. 8. That is, the resultant structure in which a first electrode layer 54*b*, a first insulating layer 54*c*, a second electrode layer 54*d*, a second insulating layer 54*e*, a third electrode layer 54*f*, a third insulating layer 54*g*, and a fourth electrode layer 54*h* are stacked upward, is obtained. Also, an annealing process for curing the ceramic paste forming the insulating layers 54*c*, 54*e*, and 54*g* is performed.

Figure 9:
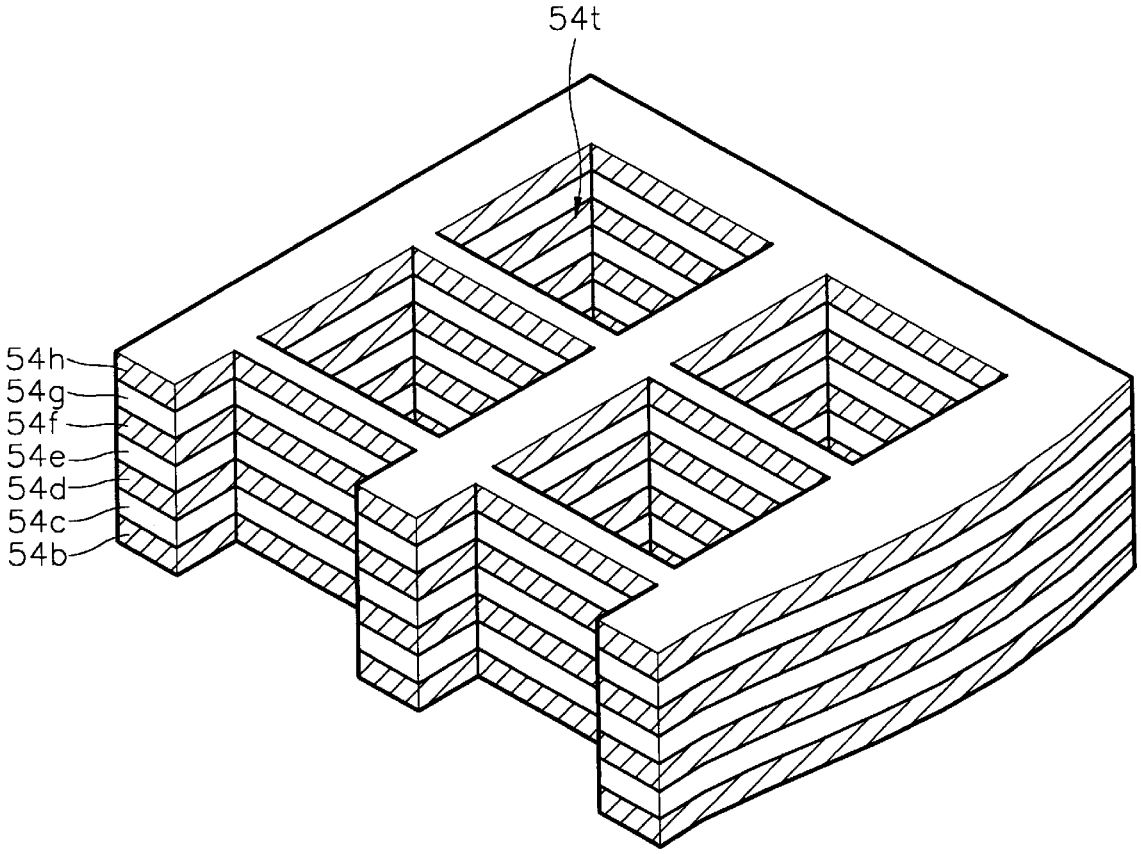
Figure 10:
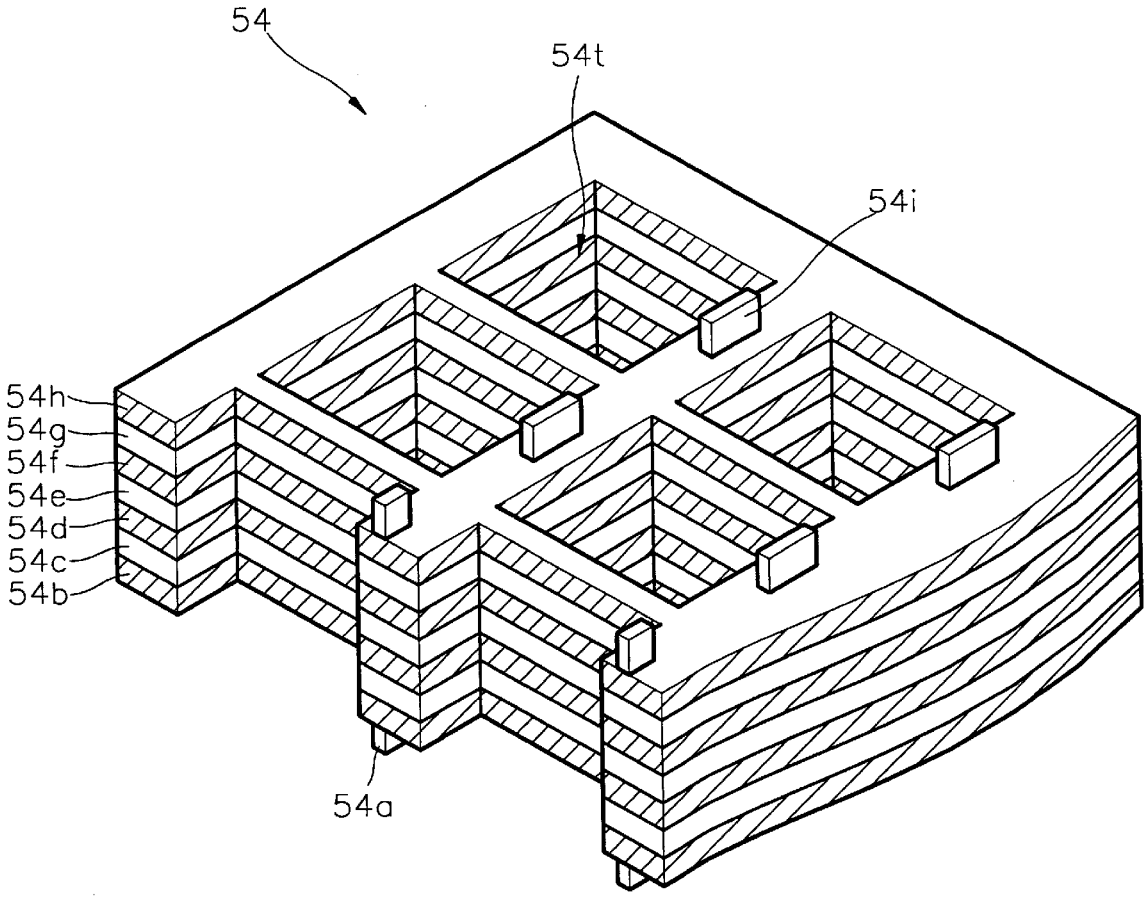

If the resultant structure forming a main body of the spacer is obtained, a multitude of vertical passing holes 54*t* which become paths of electron beams, are formed by a punching apparatus as shown in FIG. 9. Then, as shown in FIG. 10, a multitude of supports 54*a* and 54*i* formed of glass are formed in predetermined portions of each of the upper and the lower portions, to thereby complete manufacturing of the spacer 54. Also, the spacer 54 is interposed between the anode plate 51 and the cathode plate 52, and then the sealing member 53 (see FIG. 5) of the frit glass is sealed in the state in which the inside is maintained at a predetermined pressure, e.g., a vacuum pressure of approximately $10^{-7}$ torr, to thereby obtain the FED 50 shown in FIG. 5.

According to the above-described FED of the present invention, electron beams can be easily focused by the multi-focusing electrode of the spacer, and high luminance can be realized at low current due to electron beam amplification of the electron amplifying apparatus. Also, the diamond tip is used as an electron emission means, to thereby obtain a low driving voltage, stability of a high temperature, and high thermal conductivity. Also, a getter formed of a thin film is used, to thereby minimize a getter adhesion space, and an insulating layer formed of ceramic is used, to thereby suppress leakage current of the electrodes. According to the FED of the present invention and a method for manufacturing a spacer thereof, the time for manufacturing the spacer is reduced, and support stiffness is increased by the insulating layers formed of ceramic interposed between the electrode layers, to thereby increase the aspect ratio of the spacer to a desired level. Also, a multitude of electrode layers to which the negative voltage is applied, is provided in the spacer, to thereby suppress absorption of electrons to the surface of the spacer, and the number of electrons colliding against the fluorescent material is increased, to thereby improve the luminance of the device.

What is claimed is:

1. An electric field emission display (FED) including a glass substrate having a fluorescent material on the inside thereof, and functioning as an anode, and another glass substrate having tips for emitting electrons on the inside thereof and functioning as a cathode, wherein a spacer is formed between said two substrates to maintain a predetermined interval, and the spacer is composed of a multi-focusing electrode layer, an electron beam amplifying layer and a getter layer, and the tips are formed of diamond.

2. The FED of claim 1, wherein the spacer includes three bonded pieces of green sheets.

3. The FED of claim 2, wherein the multi-focusing electrode includes tungsten on the first green sheet.

4. The FED of claim 3, wherein the getter layer includes titanium on a surface of the third green sheet.

5. The FED of claim 2, wherein the electron beam amplifying layer includes tungsten on the second green sheet and an electron amplifying material on the interior surface of a via hole in the second green sheet.

6. An electric field emission display (FED) comprises:

an anode plate;

a cathode plate spaced a predetermined distance from said anode plate;

an anode on the anode plate;

a cathode on the cathode plate;

microtips arranged in a pattern on the cathode plate having a predetermined spacing;

an insulating layer formed on the cathode to surround the microtips;

gates having openings at the upper portion of the microtips and located on top of the insulating layer; and at least one spacer between the anode plate and cathode plate to maintain the interval between the anode plate and the cathode plate, wherein the spacer includes a passing hole providing a path for electrons emitted from the microtips, a layered structure of alternating electrode layers and insulating layers, and upper and lower supports formed on the upper and the lower portions of the layered structure, said spacer connecting the layered structure to the anode plate and the cathode plate, respectively.

7. The FED of claim 6, wherein the layered structure includes in sequence a first electrode layer, a first insulating layer, a second electrode layer, a second insulating layer, a third electrode layer, a third insulating layer, and a fourth electrode layer.

8. The FED of claim 7, wherein the first, the second, and the third insulating layers are made of ceramic.

9. The FED of claim 6, wherein the upper and the lower supports are made of glass.

10. An electric field emission display (FED) comprising:

a first substrate;

a fluorescent material on one surface of said first substrate;

a second glass substrate spaced from said first substrate;

tips for emitting electrons on a surface of said second substrate and facing said fluorescent material on said first substrate; and a spacer between said two substrates to maintain a predetermined interval between the first and second substrates, wherein the spacer is composed of an electrode layer, an electron beam amplifying layer and a getter layer.

* * * * *